US005556211A

United States Patent [19]

Kwon

[11] Patent Number: 5,556,211

[45] Date of Patent: Sep. 17, 1996

[54] 24 PIN DOT PRINTER HEAD AND METHOD OF MAKING THE SAME

[75] Inventor: Tai-Eun Kwon, Suwon, Rep. of Korea

[73] Assignee: SamSung Electronics Co., Ltd., Suwon, Rep. of Korea

[21] Appl. No.: 304,188

[22] Filed: Sep. 12, 1994

[30] Foreign Application Priority Data

Sep. 10, 1993 [KR] Rep. of Korea ..... 18227/1993

[51] Int. Cl.[6] ..... B41J 2/25

[52] U.S. Cl. ..... 400/124.11; 400/124.20; 400/124.29; 400/124.3

[58] Field of Search ..... 400/124.11, 124.23, 400/124.26, 124.28, 124.29, 124.3, 124.32, 124 WD, 124.07, 124.23; 29/5, 34 R, 34 D, DIG. 18; 72/47

[56] References Cited

U.S. PATENT DOCUMENTS 3,826,000 7/1974 Du Rocher et al. .
3,833,105 9/1974 Howard .
3,850,278 11/1974 Mihm et al. ..... 335/255
3,952,411 4/1976 Louis .
4,143,979 3/1979 Nelms .
4,256,948 3/1981 Wolf et al. .
4,500,027 2/1985 Nakajima .
4,569,604 2/1986 Adachi et al. .
4,652,157 3/1987 Uzawa et al. ..... 400/124
4,867,583 9/1989 Caulier et al. .

*Primary Examiner*—John S. Hilten
*Attorney, Agent, or Firm*—Robert E. Bushnell, Esq.

[57] ABSTRACT

A method for manufacturing a print wire for a 24-pin dot printer head comprises the steps of first annealing an oil temper thin elongated wire rod at a predetermined rate to remove internal strains and eliminate distortions and imperfections after the oil temper wire rod is heated at a specified temperature for a specific length of time, cold forging the wire rod at room temperature or below a recrystallization temperature to form a needle cap having two successively different diameters at one end of the wire rod and then plating the entire wire rod including the needle cap with an electroless nickel material to reinforce possible cracks occurred during the cold forging process. The wire rod may be straightened and cut before or after the formation of a needle cap.

26 Claims, 2 Drawing Sheets

24 PIN DOT PRINTER HEAD AND METHOD OF MAKING THE SAME

CROSS-REFERENCE TO RELATED APPLICATIONS

This application makes reference to, incorporates the same herein, and claims all benefits incurring under 35 U.S.C. §119 from an application for 24 Pin Dot Printer Head filed in the Korean Industrial Property Office on 10 Sep. 1993 and assigned Ser. No. 1993/18227.

BACKGROUND OF THE INVENTION

1. Technical Field

The present invention relates to a matrix printhead of a wire matrix printer, and more particularly to a method for manufacturing a print wire for use in a 24-pin dot printhead.

2. Background Art

Wire matrix printers are well known in the contempory art. Conventional matrix printers typically use a plurality of thin elongated print wires arranged in matrix fashion for making impact through a ribbon to impress the ink onto a printable medium whereby the print wires are selectively energized to form characters, numerals or other symbols. Each print wire typical has an impact receiving end and a printing end which contacts the ribbon so that a minute dot is imprinted on the printable medium. The result is a pattern of dots formed on the paper in a configuration corresponding to the desired character.

In the past, the impact receiving end of each print wire is typically designed to consist of a spiral or pig-tail like meets of wire covered in plastic; but this type of design was extremely weak at the joint where the spiral loop meets the wire stem and was consequently susceptible to high stress concentration, fatigue and eventual failure in the matrix printhead application. Improvements on the plastic covering the impact receiving end of the print wire is shown in U.S. Pat. No. 4,143,979 issued to Boyd for Printhead Needle Cap, while other designs simply sought to weld or braze a needle cap onto the end of the solid print wire. A needle cap could be replaced by a cylindrical collar as shown in U.S. Pat. No. 4,569,604 issued to Adachi et al. for Printing Head Apparatus And Manufacturing Method. Different designs on the impact receiving end of the print wire are disclosed in U.S. Pat. No. 3,718,968 issued to Sims et al. for Method For Connecting A Wire To A Component and U.S. Pat. No. 4,256,948 issued to Wolf et al. for Integral Bead Stylus Wire And Method Of Making Same where the impact receiving end of each print wire is melted by laser or plasma welding into a solid sphere-like head. The main problem with these designs is that they require costly manufacturing steps. The same is also true with a more sophisticated design disclosed in U.S. Pat. No. 4,867,583 issued to Caulier et al. for Dot Matrix Printer/Module Using Print Wires Having Different Length But Equal Mass where the print wire is a low mass hollow steel tube and the needle cap is a high wear resistant preform head designed to insert into the print wire for strong attachment.

SUMMARY OF THE INVENTION

It is accordingly an object of the present invention to provide an improved dot matrix printhead and process for manufacturing the printhead.

It is another object to provide a high quality print wire for a dot matrix printhead having an increased mechanical strength while reducing the cost of manufacturing the printhead.

It is also an object of the present invention to provide a high quality print wire for a 24-pin dot printhead with longer life span formed by an inexpensive cold forging process.

It is a further object of the present invention to provide a printhead assembly comprising an armature, a print wire with a needle cap that are integrally assembled by a cold forging process and a solenoid for driving the armature to strike the needle cap of the print wire to impress the ink of a ribbon onto a printable medium fir forming characters, numerals or other symbols.

To achieve these and other objects, the present invention contemplates on the fabrication of a print wire for a 24-pin dot printhead whereby the print wire is produced by first annealing an oil tempered thin elongated wire rod at a predetermined rate to remove internal strains and eliminate distortions and imperfections after the oil tempered wire rod is heated at a specified temperature for a specific length of time, cold forging the oil tempered wire rod in a jig to form a needle cap having preferably two successively different diameters at one end of the wire rod and then plating the entire wire rod including the needle cap with an electroless nickel material to reinforce possible cracks occurring during the cold forging process and prevent the print wire from being oxidized. The wire rod may be straightened and cut before or after the formation of a needle cap. The cold forging process of the present invention involves a process of pressing and forging the wire rod below a recrystallization temperature or at a room temperature into a jig with proper lubricants in order to integrally form a needle cap at the end of the wire rod.

It is also contemplated that the print wire for a 24-pin dot printer head be manufactured by heating and then annealing a thin and elongated wire rod having a diameter of 0.2 to 0.23 mm in order to reduce possible cracks occurred during a cold forging process, straightening and cutting the wire rod, foraging a needle cap of the print wire having a diameter of 0.5 mm by the cold forging process, and treating an electroless nickel plating of a thickness of 1–5 μm in order to reinforce any crack formed during the cold forging process. The step of forming the needle cap of the print wire and the step of cutting of the wire rod may be reversed during the manufacturing process. That is, the wire rod may be cut after the needle cap of the print wire is formed.

Additionally, the needle cap of the print wire may be cold forged into two successive stages with different diameters. The outer stage of the needle cap should have a thickness of approximately 0.5 mm; and the inner stage of the needle should have a thickness approximately of 0.3 mm. Further, the armature of the printhead assembly may also be treated with the electroless nickel plating to ensure high resistance to abrasion and to prevent oxidation. As a result, the print wire, in accordance with the present invention, has a longer life in comparison with a conventional print wire. Particularly, the print wire of the present invention can be used up to 2 billion times in comparison with the conventional print wire.

The present invention is more specifically described in the following paragraphs by reference to the drawings attached only by way of example.

BRIEF DESCRIPTION OF THE DRAWINGS

A more complete appreciation of this invention, and many of the attendant advantages thereof, will be apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
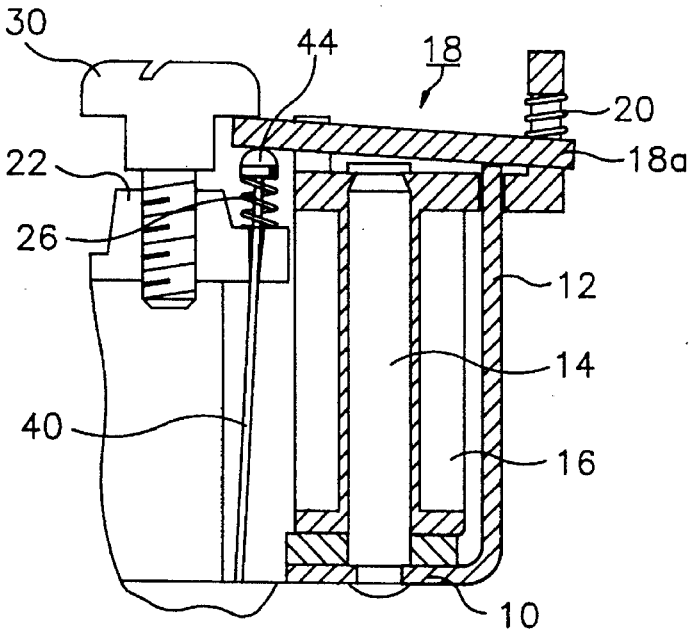
FIG. 1 is a cross-sectional view of a dot printhead comprising a print wire.

Referring now to the drawings and particularly to FIG. 1, a conventional dot printhead includes a print wire 40 having a conventional needle cap 44, an armature 18 for selectively making impact with the needle cap 44 under control of electromagnetic force activated by a solenoid, a wire guide 22 for supporting the print wire 40 in an oval position, and a spring 26 assembled in the wire guide 22 for returning the print wire 40 to an original position after the armature 18 impacts the needle cap 44 when the electromagnetic force is activated and preventing the returned print wire from rebounding. The conventional dot printhead also includes a plate 10 for uniformly arranging a number of iron cores installed outside of the wire guide 22, a return spring 20 for firmly securing the rear 18*a* of the armature 18 in the body of the plate 10, and a screw 30 positioned in the wire guide 22 for limiting spiral motion of the armature 18 around the yoke 12 held by the returning spring 20 upon receipt of the returning force of the spring 26. The plate 10 comprises a yoke 12 having an edge extended to contact close to the rear 18*a* of the armature 18, an iron core 14 and a coil member 16 mounted around the iron core 14 for making a solenoid.

When a solenoid is excited by electricity; that is when electric power is provided to the coil member 16 and the magnetic attraction is formed around the iron core 14, the armature 18 swings toward the needle cap 44 of the print wire 40 and the print wire 40 strikes a ribbon (not shown), forcing the ribbon onto a paper to form a dot configuration corresponding to the desired character. After the printing operation, the print wire 40 is returned to its original position by the spring 26.

In the conventional art, the needle cap 44 of the print wire 40 may be formed by laser, plasma welding, brazing or molding, but these conventional techniques are rather cumbersome and inefficient in mass production. For this reason, I have discovered a novel print wire structure whereby a needle cap of the print wire can be efficiently formed with an increased mechanical strength by an simple and yet inexpensive cold forging technique. The cold forging technique involved simply refers to a process of pressing and forging an oil temper, thin and elongated metallic wire rod into a jig with proper lubricants at a room temperature or below a recrystallization temperature. I have also discovered that the print wire is further stable and resilient if the rod is heated at a specified temperature for a specific length of time and then annealed or gradually cooled at a predetermined rate prior to being cold forged to form the needle cap. Annealing is necessary to maximize the mechanical strength of the print wire and minimize internal strains in the metal and potential cracks occurring during the cold forging process. Further, a thin layer of electroless nickel plating on the print wire including the needle cap is also necessary to fortify the strength of the metal and reinforce all potential cracks that occurred during the cold forging process as well as preventing oxidation of the metal.

If the dot printhead is a 9-pin dot printhead, the needle cap of the print wire generally has a diameter of 0.6 mm and can be formed on one end of an oil tempered, thin and elongated wire rod having a diameter of 0.3 mm by a cold forging process. There is no need to anneal the wire rod before the formation of the needle cap of the print wire by the cold forging process because the thickness of the wire rod generally provides sufficient mechanical strength to withstand potential cracks that occurred during the cold forging process and repeated printing operations.

If the dot printhead is a 24-pin dot printhead however, the print wire is even smaller than the print wire of the 9-pin dot printhead in order to accommodate the same print width of the 9-pin dot printhead. In a 24-pin dot printhead, the printhead assembly has 24 print wires and each print wire is made of a wire rod having a diameter of approximately 0.2–0.23 mm. The needle cap of each individual print wire has a diameter 2.5 times larger than that of the print wire and is of approximately 0.5 min. In this case, if the needle cap of the print wire is formed by a cold forging process, the print wire may be easily broken primarily due to the cracks occurred during the cold forging process.

For example, as shown in FIG. 1, the printhead assembly normally requires the armature 18 to strike the needle cap 44 of the print wire 40 with a power of 1.2 pounds and the spring 26 to possess a weight of 13 gram forces. If the print wire 40 fabricated by my cold forging process alone is operated to contact with a platen (not shown), the print wire 40 is typically broken after having a life span up to 80–120 million times of repeated printing operations. On the other hand, if the print wire 40 is operated without contacting with anything, the print wire is 40 broken after having a life span up to only 5 million times of repeated printing operations.

If the print wire 40 is however fabricated in accordance with another aspect of the invention i.e., by the cold forging process in combination with the annealing of the wire rod prior to the formation of the needle cap and the electroless nickel plating of the wire rod including the needle cap, the life span of the print wire is increased up to 2 billion times.

Figure 2:
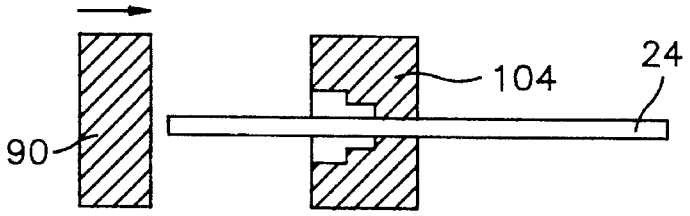
FIG. 2 illustrates a process of manufacturing a novel needle cap of the print wire according to the present invention.

Turning now to FIG. 2–5 of the present invention. FIG. 2 illustrates the formation of a needle cap of a print wire 24. The print wire 24 is actually an oil temper, thin and elongated wire rod having a diameter of approximately 0.2–0.23 mm. When the print wire 24 is positioned in a jig 104 having a recess of two successive internal stages, a hammer 90 is used to cold forge the print wire 24 into the recess with proper lubricants at room temperature or temperature below a recrystallization level to form a needle cap 100 comprising two successive stages of different diameters shown in FIG. 3. The larger diameter of the two stages is of approximately 0.5 mm; and the smaller diameter thereof is approximately 0.3 mm. The smaller stage is designed to firmly secure the spring 26 in the oval position of the wire guide 22 as shown in FIG. 1 for making sure that the print wire 24 return to its original position after each printing operation. Thus, the actual diameter of the smaller stage may slightly vary in accordance with the circumference of the spring 26 used. It is also contemplated by the present invention however that a jig 104 may only have a recess of one internal stage; that is, depending upon the case of fabrication, the needle cap 100 of the print wire 24 may only have one stage of one diameter.

Figure 3:
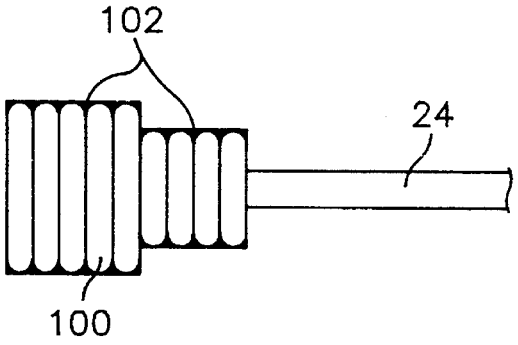
FIG. 3 illustrates a formation of an electroless nickel plating on the needle cap of a print wire according to the present invention.

The strength of the print wire 24 formed by the cold forging process should be maintained up to 2 times of the diameter of the wire rod. However, if this limit is exceeded, cracks may occur in the needle cap 100 of the print wire 24 as a result of the cold forging process. Thus, in order to prevent the boundary between the needle cap 100 of the print wire 24 and the print wire 24 itself from being broken by the cracks, the entire print wire 24 including the needle cap 100 is treated, as shown in FIG. 3, with an electroless nickel plating in order to uniformly maintain the strength of the metal. Nickel plating on the print wire 24 including the needle cap 100 is also desirable to prevent the print wire 24 from being oxidized; that is, the nickel plating is also a rust-proof treatment that would last throughout the lifespan of the print wire 24. In the past, conventional art requires that anti-corrosive materials be applied on the print wire 24 only for storage purposes to prevent oxidation, but the anti-corrosive materials must subsequently be removed before actual use so as to prevent physical damage to the printhead resulting from chemical reaction between the anti-corrosive materials and heat generated from the printing operation of the printhead. In the present invention however, the application of the electroless nickel plating would not only provide a life time rust-free protection for the print wire 24, but would also advantageously eliminate the cumbersome step of removing the anticorrosive materials from the print wire 24 before use.

Further, as mentioned above, the print wire 24 operates with the spring 26 which is assembled into the smaller stage of the two stages 102 of the needle cap 100. The print wire 24 is assembled into the recess of the wire guide 22. Since the needle cap 100 of the print wire 24 is positioned to contact with the armature 18, the surface of both the needle cap 100 and the armature 18 would wear down quickly due to the difference degree of hardness between the print wire 24 and the armature 18. It is also contemplated that the armature 18 be treated with the electroless nickel plating as well in order to ensure high resistant to abrasion. Alternatively, it is also possible to cover the needle cap 100 with a thin layer of plastic materials with high stiffness, toughness and high abrasion resistivity in order to achieve the same objective; that is, to ensure high resistant to abrasion between the needle cap 100 and the armature 18.

Figure 4:
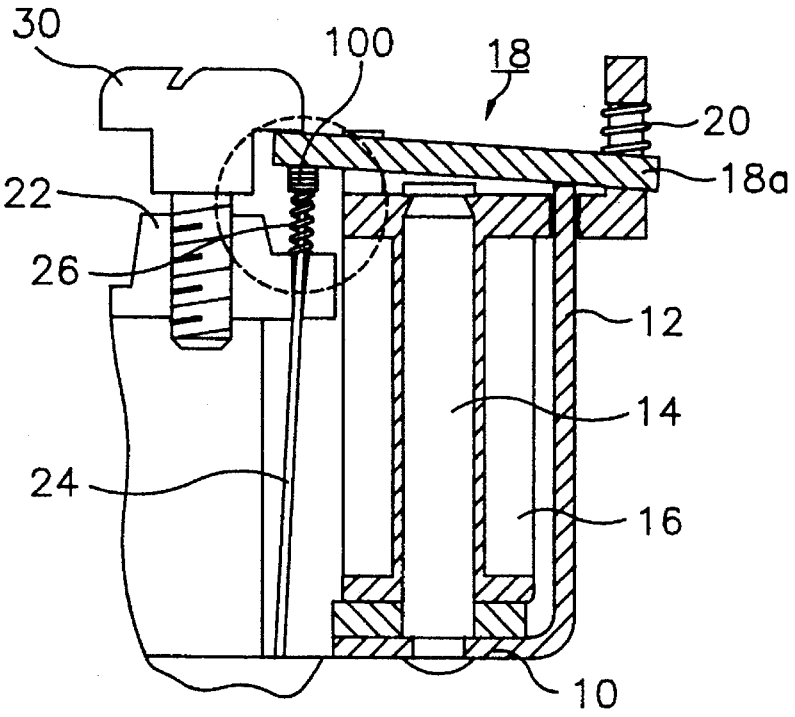
FIG. 4 is a cross-sectional view of a dot printhead comprising a novel needle cap of a print wire according to the present invention.
Figure 5:
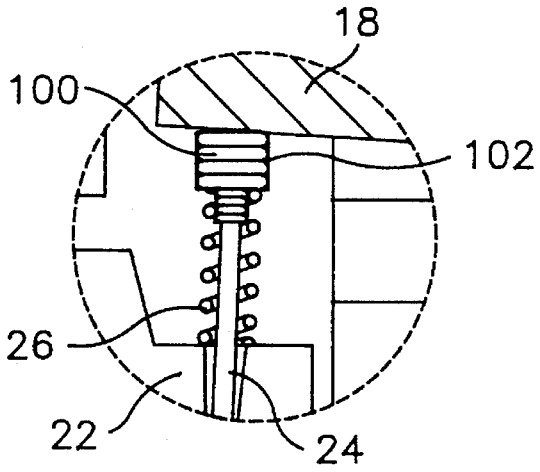
FIG. 5 is a detailed view showing the novel needle cap of the print wire according to the present invention shown in FIG. 4.

Turning now to FIG. 4, if electric power is provided to the round coil member 16, the magnetic attraction is formed around the iron core 14, so that the armature 18 is attracted to the iron core 14. The armature 18 strikes the needle cap 100 of the print wire 24 and the print wire 24 strikes the ribbon (not shown), the paper and the platen, moving along the wire guide 22 in order to conduct a printing operation. FIG. 5 illustrates the novel needle cap of the print wire according to the present invention shown in FIG. 4 in greater detail.

After one printing operation, the print wire is under a stand-by state for a next printing operation. The print wire 24 moves along the wire guide 22 by the return power of the spring 26 which is assembled around the smaller stage of the two stages 102 of the needle cap 100 and the return spring 20 which is mounted in the rear of the armature 18*a*.

As discussed above, in the 24-pin dot printer head according to the aspect of the present invention, the hardness of the print wire is the same as that of the armature in order to ensure the longevity of the printer head. Further, it is possible to adjust the diameter of the print wire according to the thickness of the plating. The annealing of the wire rod is necessary to reduce the cracks occurred during the cold forging process. Specially, the electroless nickel plating treatment is performed in the print wire so as to reinforce the crack portion, prevent the print wire from being oxidized, and reduce the wear and tear occurred by the difference of the hardness between the print wire and the armature.

While the preferred embodiments of the invention have been particularly shown and described, it will be understood by those skilled in the art that the foregoing and other changes in form and detail may be made without departing from the spirit and scope of the invention as defined in the appended claims and that it may be possible, for example, to define the structure of the needle cap of the print wire with only one uniform diameter. Moreover, the principles of the invention are also directly applicable to all types of print wires.

What is claimed is:

1. A method for manufacturing a print wire for a 24-pin dot printer head comprising the following sequential steps of:

heating a wire rod at a specified temperature for a specific length of time;

annealing the wire rod at a predetermined rate;

cold forging one end of the wire rod to form a needle cap with two successively different diameters with respect to the diameter of the wire rod; and plating the entire wire rod including the needle cap with nickel plating.

2. A method as claimed in claim 1, further comprising the step of cutting said wire rod at a predetermined length corresponding to a size of said print wire before the formation of the needle cap of said wire rod.

3. A method as claimed in claim 1, further comprising the step of cutting said wire rod at a predetermined length corresponding to a size of said print wire after the formation of the needle cap of said wire rod.

4. A method as claimed in claim 1, said step of cold forging comprised of forming said needle cap integrally and continuously at one end of said wire rod, coaxially with said wire rod.

5. A method as claimed in claim 4, comprised of performing said cold forging of said one end of said wire rod to form said needle cap with two successively different diameters comprising an outer diameter of 0.5 mm and a contiguous inner diameter of approximately 0.3 mm.

6. A method as claimed in claim 5, comprised of performing said cold forging of said one end of said wire rod to form said needle cap with said outer diameter of said needle cap being twice larger than a diameter of said wire rod.

7. A method as claimed in claim 1, comprised of said plating forming a thickness of approximately 1–5 μm.

8. A 24-pin dot printer head formed by the following sequential steps of:

straightening a wire rod exhibiting a cross-sectional dimension;

heating and then annealing said wire rod;

forming a needle cap at one end of said wire rod by a cold forging process applied to one end of said wire rod to form said needle cap with a plurality of successively different cross-sectional dimensions each successively greater than said cross-sectional dimension; and plating said wire rod including the needle cap to reinforce cracks occurring during said cold forging process.

9. A 24-pin dot printer head as claimed in claim 8, comprising:

after forming the needle cap by said cold forging process, forming a print wire by cutting said wire rod to separate from said wire rod on integral structure comprised of said needle cap and an adjoining length of said wire rod.

10. A 24-pin dot printer head as claimed in claim 8, comprised of forming said needle cap with a diameter of 0.5 mm by colding forging said one end of the wire rod into a jig.

11. A 24-pin dot printer head as claimed in claim 8, comprised of forming said needle cap with a diameter twice larger than a diameter of said wire rod.

12. A 24-pin dot printer head as claimed in claim 8, comprising nickel plating said wire rod and needle cap with nickel to a thickness of approximately 1–5 μm.

13. A method for manufacturing a print wire for a 24-pin dot printer head comprising the following sequential steps of:

annealing a wire rod;

forming a needle cap having two successive stages of different and progressively greater diameters with respect to the diameter of said wire rod by a cold forging process applied to one end of said wire rod; and plating said wire rod including the needle cap with nickel plating.

14. A method as claimed in claim 13, comprised of:

after said cold forging of said wire rod to form said needle cap, forming said print wire by straightening and cutting said wire rod to separate from said wire rod an integral structure comprised of said needle cap and an adjoining length of said wire rod.

15. A method as claimed in claim 13, wherein said wire rod has a diameter of approximately 0.2–0.23 mm.

16. A method as claimed in claim 13, said step of forming further comprised of cold forging one end of said wire rod to form said needle cap with two successively different diameters comprising an outer diameter of 0.5 mm and a contiguous inner diameter of 0.3 mm.

17. A method as claimed in claim 13, comprised of said plating said wire rod and said needle cap with nickel to a thickness of approximately 1–5 μm.

18. A printhead assembly, comprising:

a housing;

a print wire having an elongate intermediate body terminated at opposite ends by a needle cap and a printing end with said needle cap being formed from a terminal portion of said intermediate body as an integral and monolithic terminal end of said intermediate body, for performing dot printing by impinging said printing end on a sheet of a printable media in response to force applied to said needle cap, said intermediate body exhibiting a first cross-sectional dimension and said needle cap exhibiting two different cross-sectional dimensions successively greater than said first cross-sectional dimension;

an armature having one end positioned to strike upon the needle cap of the print wire;

solenoid means for enabling, when excited, the armature to pivot about the other end of said armature to apply said force to said needle cap, thereby causing said print wire to move from a non-printing position to a printing position;

a return spring for biasing said armature to return said print wire to said non-printing position when said solenoid means is not being excited; and said print wire being formed by cold forging one end of a wire rod to form said needle cap after heating and annealing the wire rod; said print wire including said needle cap being plated with nickel plating after said cold forging.

19. A printhead assembly as claimed in claim 18, comprised of said wire rod having a diameter of approximately 0.2–0.23 mm and said needle cap having a diameter of approximately 0.5 mm formed by colding forging one end of the wire rod into a die.

20. A printhead assembly as claimed in claim 18, comprised of said needle cap having two successively different diameters with an outer diameter of 0.5 mm and a contiguous inner diameter of 0.3 mm formed by cold forging one end of the wire rod into a jig, and said nickel plating having a thickness of approximately 1–5 μm.

21. A printhead assembly as claimed in claim 18, with said intermediate body and said needle cap comprising an identical material.

22. A printhead assembly as claimed in claim 19, with said intermediate body and said needle cap comprising an identical material.

23. A method for manufacturing a print wire for a 24-pin dot printer head comprising the following sequential steps of:

heating a wire rod at a specified temperature for a specific length of time;

annealing the wire rod at a predetermined rate;

cold forging one end of the wire rod to form a needle cap with two successively different diameters with respect to the diameter of the wire rod; and plating the needle cap with nickel.

24. A method as claimed in claim 23, said step of cold forming comprised of forming said needle cap integrally and continuously at one end of said wire rod with said wire rod.

25. A printhead assembly, comprising:

a housing;

a print wire having an elongate intermediate body terminated at opposite ends by a needle cap and a printing end with said needle cap being formed from a terminal portion of said intermediate body as an integral and monolithic terminal end of said intermediate body, for performing dot printing by impinging said printing end on a sheet of a printable media in response to force applied to said needle cap, said intermediate body exhibiting a first cross-sectional dimension and said needle capexhibiting two different cross-sectional dimensions successively greater than said first cross-sectional dimension;

an armature having one end positioned to strike upon said needle cap of the print wire;

solenoid means for enabling, when excited, the armature to pivot about the other end of said armature to apply said force to said needle cap, thereby causing said print wire to move from a non-printing position to a printing position;

a return spring biasing said armature to return said print wire to said non-printing position when said solenoid means is not being excited; and said print wire being formed by cold forging one end of a wire rod to form said needle cap after heating and annealing said wire rod, said needle cap being plated with nickel after said cold forging.

26. A printhead assembly of claim 25, comprised of said wire rod having a diameter of approximately 0.2–0.23 mm and said needle cap having a diameter of approximately 0.5 mm formed by colding forging one end of the wire rod into a die.

* * * * *